United States Patent [19]

Snelling

[11] 4,174,903

[45] Nov. 20, 1979

[54] COMBINED PROCESSING STATION FOR USE IN AN ELECTROPHOTOGRAPHIC PRINTING MACHINE

[75] Inventor: Christopher Snelling, Penfield, N.Y.

[73] Assignee: Xerox Corporation, Stamford, Conn.

[21] Appl. No.: 892,610

[22] Filed: Apr. 3, 1978

[51] Int. Cl.[2] ..... G03G 15/22

[52] U.S. Cl. ..... 355/3 CH; 118/657; 355/3 DD; 355/3 TR

[58] Field of Search ..... 96/1 C, 1 SD; 118/657, 118/658; 355/3 R, 3 CH, 3 DD, 3 TE, 3 TR

[56] References Cited

U.S. PATENT DOCUMENTS

| | | | |
|---|---|---|---|
| 3,850,662 | 11/1974 | Jahn | 118/657 X |
| 3,971,658 | 7/1976 | Goffe | 96/1 C |
| 4,087,170 | 5/1978 | Sawaoka et al. | 355/3 CH |
| 4,102,305 | 7/1978 | Schwarz | 118/658 |
| 4,105,320 | 8/1978 | Bean | 355/3 TR |

OTHER PUBLICATIONS

Fowler, "Simultaneously Charging & Wetting a Photoconductive Surface", IBMTDB vol. 17, No. 5, Oct. 1974, p. 1478.

*Primary Examiner*—A. D. Pellinen
*Attorney, Agent, or Firm*—J. J. Ralabate; C. A. Green; H. Fleischer

[57] ABSTRACT

An electrophotographic printing machine in which a single processing station performs the functions of charging a photoconductive member and developing an image recorded thereon. In addition, this processing station may perform the additional function of transferring the powder image from the photoconductive member to the copy sheet.

22 Claims, 3 Drawing Figures

COMBINED PROCESSING STATION FOR USE IN AN ELECTROPHOTOGRAPHIC PRINTING MACHINE

BACKGROUND OF THE INVENTION

This invention relates generally to the electrophotographic printing machine, and more particularly concerns an improved processing station which may perform the functions of charging, developing and transferring.

In an electrophotographic printing process, a photoconductive member has its surface charged to a substantially uniform level. The charged photoconductive member is exposed to a light image of the original document being reproduced. Exposure of the sensitized photoconductive surface selectively discharges the charge thereon. This records an electrostatic latent image on the photoconductive surface corresponding to the informational areas contained with the original document being reproduced. Development of the electrostatic latent image recorded on the photoconductive surface is achieved by bringing developer material into contact therewith. Typical developer materials employ toner particles and carrier granules. Generally, the toner granules are made from heat settable thermoplastic particles, while the carrier granules are made from coarser ferromagnetic granules. Alternatively, the developer material may comprise a single component, such as fine conductive magnetic particles. In either case, when the developer material is brought into contact with the latent image recorded on the photoconductive surface, the greater attractive force thereof causes particles to adhere to the electrostatic latent image.

Hereinbefore each of the foregoing steps were performed at an individual processing station. For example, the charging step is performed at a charging station, exposure at an exposure station, development at a development station, and transfer at a transfer station. Each processing step required individual stations which were separate and independent from one another. The broad concept of electrophotographic printing was originally disclosed by Carlson and U.S. Pat. No. 2,297,691 and is further amplified and described by many related patents, in the art. U.S. Pat. No. 2,846,333 issued to Wilson in 1956, describes a typical single component developer material.

It is a primary object of the present invention to improve electrophotographic printing machines by reducing the number of processing stations employed therein.

PRIOR ART STATEMENT

Various types of devices have hereinbefore been developed to reduce the required number of processing stations in an electrophotographic printing machine. The following prior art appears to be relevant: Cooper—U.S. Pat. No. 3,637,306—Jan. 25, 1972. Queener—U.S. Pat. No. 3,647,293—Mar. 7, 1972.

The pertinent portions of the foregoing prior art may be briefly summarized as follows:

Cooper discloses an electrophotographic printing machine employing a combined developing-cleaning unit. The unit is operable to perform either function at the proper time during the copying sequence. This unit is an magnetic brush developer unit that serves both as the developer and cleaner in the system.

Queener also describes a combined developing-cleaning unit. The unit is a magnetic brush developer unit that serves as both a developer and cleaner in the system. In the developing mode, toner particles are attracted from the carrier granules of the unit to the photoconductive layer. When used in the cleaning mode, the brush rotates and the developer mixture is brushed against the photoconductive layer to scavenge residual toner particles remaining thereon.

SUMMARY OF THE INVENTION

Briefly stated, and in accordance with the invention, there is provided an electrophotographic printing machine for reproducing at least one copy of an original document.

Pursuant to the features of the present invention, the printing machine includes a photoconductive member and a combined charging-developing unit. The combined unit is positioned in communication with the photoconductive member at a single station so as to charge at least a portion of the photoconductive member in one mode and develop an image recorded thereon in another mode. In addition to the foregoing, the combined unit may also effect transfer of the particles from the photoconductive member to the copy sheet in image configuration.

BRIEF DESCRIPTION OF THE DRAWINGS

Other objects advantages of the present invention will become apparent upon reading the following detailed description and upon reference to the drawings, in which.

Figure 1:
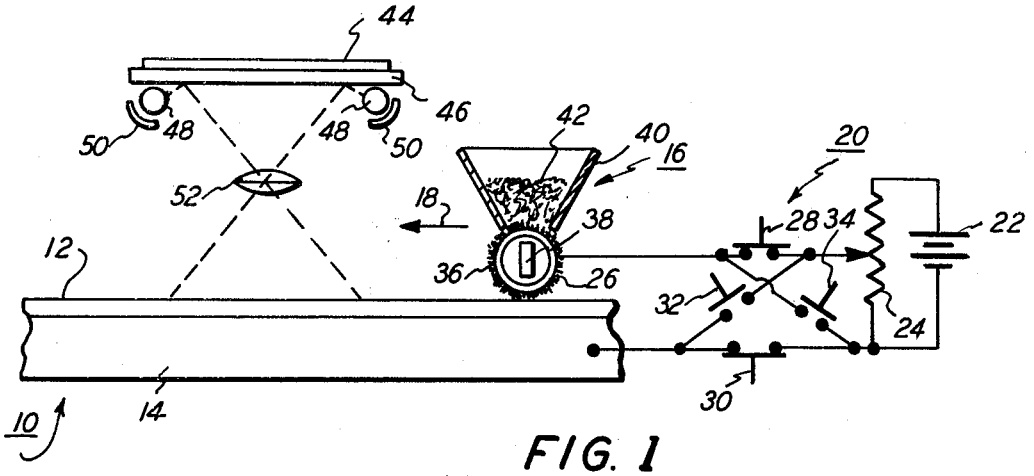
FIG. 1 illustrates schematically the operation of and electrophotographic printing machine employing the combined unit.

While the present invention will hereinafter be described in connection with a preferred embodiment thereof, it will be understood that it is not intended to limit the invention to that embodiment. On the contrary, it is intended to cover all alternatives, modifications and equivalents as may be included within the spirit and scope of the invention as defined by the appended claims.

DETAILED DESCRIPTION OF THE INVENTION

For a general understanding of an electrophotographic printing machine incorporating the features of the present invention therein reference is made to the drawings which depict schematically the various components thereof. Hereinafter, like reference numerals will be employed throughout to designate identical elements. Although the apparatus of the present invention is particularly well adapted for use in an electrophotographic printing machine, it should become evident from the following discussion that it's equally well suited for use in a wide variety of electrostatographic printing machines and is not necessary limited in its application to the particular embodiment shown herein.

Referring initially to FIG. 1, the electrophotographic printing system includes a photoconductive member 10 having a photoconductive surface 12, preferably made from a selenium alloy such as described in U.S. Pat. No. 2,970,906 issued to Bixby in 1961. Photoconductive surface 12 is secured to a conductive substrate 14 made preferably from aluminum.

Initially, combined charging-developing-transferring unit 16 translates in the direction of arrow 18 across photoconductive surface 12 to charge the surface thereof to a relatively high substantially uniform potential. During the charging step, combined unit 16 is electrically biased by voltage source 20 to about 800 volts. Voltage source 20 comprises a constant voltage source 22 connected in parallel with a transformer 24. The output from transformer 24 is coupled to tubular member 26 of combined unit 16 and conductive substrate 14 of photoconductive member 10. During the charging step, switches 28 and 30 are closed while switches 32 and 34 remain open. Combined unit 16 comprises tubular member 26, preferably made from a non-magnetic material such as aluminum having the exterior surface thereof roughened so that the magnetic conductive particles 36 adhere thereto. Preferably, particles 36 have a conductivity of about $10^4$ ohm centimeters.

As shown in FIG. 1, tubular member 26 is interfit over magnetic member 38. In this way, magnetic member 38 is disposed internally of tubular member 26 so as to form a magnetic field about the periphery thereof. Preferably, magnetic member 38 is made from barium ferrite having a plurality of magnetic poles impressed about the surface thereof. In one embodiment, tubular member 26 rotates while magnetic member 38 remains stationary. Alternatively, tubular member 26 may remain stationary while magnetic member 38 rotates. In either case, conductive particles 36 remain adhering to the surface of tubular member 26 during the charging process. Tubular member 26 is positioned closely adjacent to photoconductive surface 12.

Hopper 40 stores a supply of particles 36 in chamber 42. The particles are dispensed through the opening in chamber 42 onto the surface of tubular member 26. As previously noted, particles 36 are preferably conductive and magnetic. Particles 36 are attracted by magnetic member 38 to the roughened exterior surface of tubular member 26. As either tubular member 26 rotates or the magnetic member 38 rotates, the particles are advanced into the gap between photoconductive surface 12 and tubular member 26.

During the charging step, the particles initially deposit on photoconductive surface 12 and subsequently return to tubular member 26. It is believed that as the charge exchange relaxed the electrostatic bonding force, it allowed the magnetic attraction to predominate causing the particles to return to tubular member 26.

After combined unit 16 is translated in the direction of arrow 18 across photoconductive surface 12, the charged portion thereof is exposed to a light image of original document 44. Original document 44 is positioned face down on a stationary, transparent platen 46 which is preferably a glass plate, or the like, and functions to support the original document thereon. Lamps 48 in conjunction with light reflectors 50, flash on to illuminate original document 44. The light rays reflected from the original document 44 are transmitted through lens 52 resulting in a light image of original document 44 being projected onto the charged portion of photoconductive surface 12. The light image selectively dissipates the charge on photoconductive surface 12 to record an electrostatic latent image corresponding to the original document.

Next, combined unit 16 develops electrostatic latent image recorded on photoconductive surface 12. Switches 28 and 30 are opened de-coupling combined unit 16 from voltage source 20. As combined unit 16 translates in the direction of arrow 18, particles are deposited from the brush thereof adhering to tubular member 26 onto the charged portion of photoconductive surface 12, i.e. the electrostatic latent image. In this way, the electrostatic latent image is developed with particles forming a powder image on photoconductive surface 12 corresponding to the informational areas of original document 44.

Figure 2:
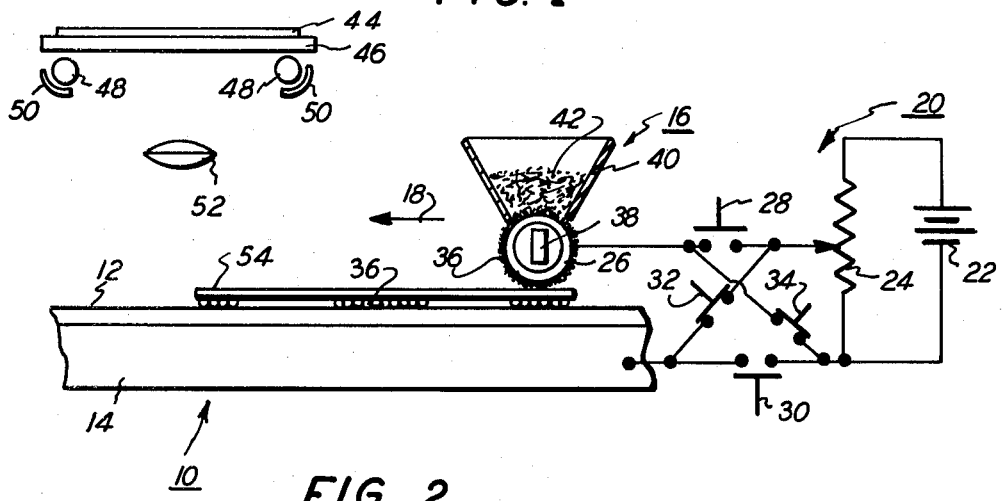
FIG. 2 depicts schematically the FIG. 1 combined unit transferring particles from the latent image recorded on a photoconductive member to a copy sheet.

Turning now to FIG. 2, there is shown the operation of combined unit 16 to effect transfer of particles 36 from photoconductive surface 12 to copy sheet 54. As shown in FIG. 2, copy sheet 54 is disposed over photoconductive surface 12 having one side thereof in contact with particles 36 on photoconductive surface 12. At this time, switches 28 and 30 are opened and switches 32 and 34 are closed. This reverses the polarity of the DC voltage applied to tubular member 26. Combined unit 16 now translates again in the direction of arrow 18. The particles on tubular member 26 contact the other side of copy sheet 54. As combined unit 16 translates across copy sheet 54, particles 36 adhering to photoconductive surface 12 are attracted to copy sheet 54 in image configuration. After transfer, copy sheet 54 is separated from photoconductive surface 12 and advanced to a fusing station (not shown).

The fusing station permanently affixes the transferred particles to copy sheet 54 in image configuration. After the particles are permanently affixed to the copy sheet, the copy sheet is advanced by a suitable conveyor to a catch tray for subsequent removal from the printing machine by the operator.

Invariably, after the copy sheet is stripped from photoconductive surface 12, some residual particles remain adhering to the photoconductive surface. These residual toner particles may be removed from photoconductive surface 12 by once again translating combined unit 16 across photoconductive surface 12. The combined unit is selectrically biased to the appropriate polarity and magnitude, as taught by the prior art references, for example, U.S. Pat. Nos. 3,637,306 and 3,647,293. In this manner, the residual particles are removed from photoconductive surface 12. Finally, any residual charge remaining on photoconductive surface 12 is removed therefrom by actuating a discharge lamp (not shown) which floods photoconductive surface 12 with light to dissipate any residual electrostatic charge remaining thereon prior to the initiation of charging for the next successive imaging cycle.

It is believed that the foregoing description clearly illustrates the operation of combined unit 16 in an electrophotographic printing machine.

Figure 3:
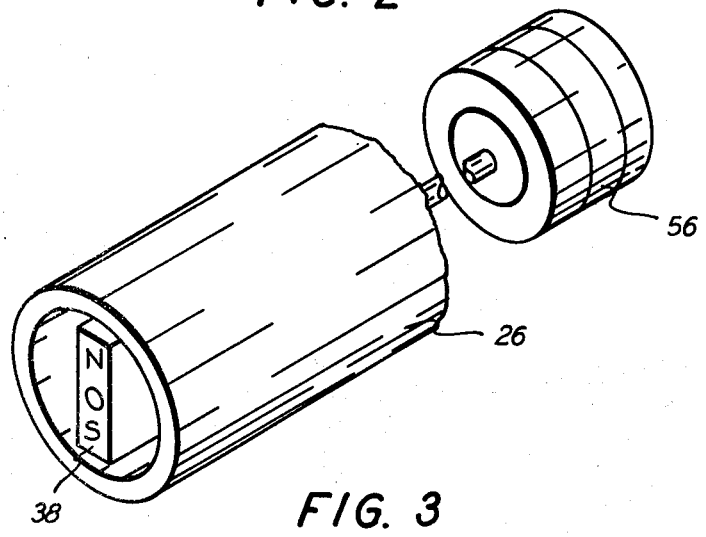
FIG. 3 is a schematic elevational view showing the FIG. 1 combined unit.

Turning to FIG. 3, there is shown the detailed structure of a portion of combined unit 16. As depicted therein, tubular member 26 is interfit concentrically over magnetic member 38. Magnetic member 38 is shown as being a bar magnet having a north and south pole impressed at opposed end regions thereof. Tubular member 26 is non-magnetic. As previously indicated, preferably magnetic member 38 is made from barium ferrite while tubular member 26 is made from aluminum having the exterior circumferential surface thereof roughened. Motor 56 is coupled either to tubular member 26 or magnetic member 38. Thus, in one embodiment, tubular member 26 is rotated by motor 56 while magnetic member 38 remains stationary. Alternatively, in another embodiment, tubular member 26 may remain stationary while magnetic member 38 is rotated by motor 56. Thus, depending upon the embodiment employed, tubular member 26 may be mounted for rotation by a suitable bearing or fixed stationarily. Similarly, magnetic member 38 may be fixed stationarily or mounted for rotation on suitable bearings.

In recapitulation, it is evident that the combined unit of the present invention performs a plurality of functions at a single processing station in an electrophotographic printing machine. The combined unit may perform the functions of charging, developing and transferring at a single processing station. Alternatively, this unit may be employed to perform any one of the foregoing functions singularly. In this manner, the complexity and cost of an electrophotographic printing machine is significantly reduced.

It is, therefore, evident that there has been provided in accordance with the present invention an electrophotographic printing machine that fully satisfies the objects, aims advantages hereinbefore set forth. While this invention has been described in conjunction with a specific embodiment thereof, it is evident that many alternatives, modifications and variations will be apparent to those skilled in the art. Accordingly, it is intended to embrace all alternatives, modifications and variations that fall within the spirit and broad scope of the appended claims.

What is claimed is:

1. An electrophotographic printing machine for reproducing at least one copy of an original document, including:

a photoconductive member; and a combined charging-developing unit having conductive particles adhering to a surface thereof and being positioned so that the conductive particles contact said photoconductive member, said charging-developing unit being electrically biased to a first polarity and magnitude for charging at least a portion of said photoconductive member in a first mode with the conductive particles remaining substantially adhering to the surface of said combined charging-developing unit, said charging-developing unit being electrically biased to a second polarity and magnitude for developing an image recorded on said photoconductive member with the conductive particles in a second mode.

2. A printing machine as recited in claim 1, further including means for exposing the charged portion of said photoconductive member to record thereon a latent image corresponding to the original document.

3. A printing machine as recited in claims 1 or 2, further including means for selectively actuating said combined unit so that in the first mode said combined unit charges said photoconductive member prior to recording thereon the latent image and, in the second mode, develops the image after the recording thereof on said photoconductive member.

4. A printing machine as recited in claim 3, wherein said combined unit includes:

a means for positioning the conductive particles closely adjacent to said photoconductive members; and means for electrically biasing said positioning means, said actuating means connecting said biasing means to said positioning means in the charging mode and isolating said positioning means from said biasing means in the developing mode.

5. A printing machine as recited in claim 4, wherein positioning means includes:

a tubular member; and means, disposed internally of said tubular member, for producing a magnetic field about the periphery of said tubular member to attract the conductive particles thereto.

6. A printing machine as recited in claim 5, wherein said positioning means includes means for rotating said tubular member relative to said producing means.

7. A printing machine as recited in claim 5, wherein said positioning means includes means for rotating said producing means relative to said tubular member.

8. An electrophotographic printing machine for reproducing at least one copy of an original document, including:

a photoconductive member; and a combined charging-developing-transferring unit in communication with said photoconductive member at a single station for charging at least a position of said photoconductive member in a first mode, developing an image recorded on said photoconductive member with conductive particles in a second mode, and transferring the conductive particles from the image recorded on said photoconductive member to the copy sheet in a third mode.

9. A printing machine as recited in claim 8, further including means for exposing the charged portion of said photoconductive member to record thereon a latent image corresponding to the original document.

10. A printing machine as recited in claim 8 or 9, further including means for selectively actuating said combined unit so that in the first mode said combined unit charges said photoconductive member prior to recording the latent image thereon, in the second mode, said combined unit develops the latent image with conductive particles after the recording thereof on said photoconductive member and, in the third unit, said combined unit transfers the conductive particles from the latent image recorded on said photoconductive member to the copy sheet.

11. A printing machine as recited in claim 10, wherein said combined unit includes:

means for positioning the conductive particles closely adjacent to said photoconductive members; and means for electrically biasing said positioning means, said actuating means connecting said biasing means to said positioning means in the charging mode, and isolating said positioning means from biasing means in the developing mode.

12. A printing machine as recited in claim 11, wherein said positioning means includes:

a tubular member; and means, disposed internally of said tubular member, for producing a magnetic field about the periphery of said tubular member to attract the conductive particles thereto.

13. A printing machine as recited in claim 12, wherein said positioning means includes means for rotating said tubular member relative to said producing means.

14. A printing machine as recited in claim 12, wherein said positioning means includes means for rotating said producing means relative to said tubular member.

15. An apparatus for charging a photoconductive member, including:

means for positioning conductive particles in communication with the photoconductive member; and means for electrically biasing said positioning means so that said positioning means charges the photoconductive member and the conductive particles remain substantially adhering to said positioning means.

16. An apparatus as recited in claim 15, wherein positioning means includes:

a tubular member; and means, disposed internally of said tubular member, for producing a magnetic field about the periphery of said tubular member to attract the conductive particles thereto.

17. An apparatus as recited in claim 16, wherein said positioning means includes means for rotating said tubular member relative to said producing means.

18. An apparatus as recited in claim 16, wherein said positioning means includes means for rotating said producing means relative to said tubular member.

19. An apparatus for transferring conductive particles from a latent image recorded on a photoconductive member to a copy sheet, including:

means for positioning the conductive particles in communication with one surface of the copy sheet; and means for electrically biasing said positioning means to attract the particles from the latent image to the other surface of the copy sheet with the conductive particles remaining substantially adhering to said positioning means.

20. An apparatus as recited in claim 19, wherein said positioning means includes:

a tubular member; and means, disposed internally of said tubular member, for producing a magnetic field about the periphery of said tubular members to attract the conductive particles thereto.

21. An apparatus as recited in claim 20, wherein said positioning means includes means for rotating said tubular member relative to said producing means.

22. An apparatus as recited in claim 20, wherein said positioning means includes means for rotating said producing means relative to said tubular member.

* * * * *